US010476192B2

(12) United States Patent
Huang et al.

(10) Patent No.: US 10,476,192 B2
(45) Date of Patent: Nov. 12, 2019

(54) ELECTRICAL CONNECTOR WITH CONDUCTIVE TERMINALS

(71) Applicant: SPEED TECH CORP., Taoyuan (TW)

(72) Inventors: Kuo-Hua Huang, Taoyuan (TW); Cheng-Hsiang Hsueh, Taoyuan (TW); I-Ting Hsieh, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 15/709,466

(22) Filed: Sep. 19, 2017

(65) Prior Publication Data

US 2018/0294592 A1 Oct. 11, 2018

(30) Foreign Application Priority Data

Apr. 6, 2017 (TW) ..... 106204892 U

(51) Int. Cl.

| | |
|---|---|
| ***H01R 13/405*** | (2006.01) |
| ***H01R 12/72*** | (2011.01) |
| ***H01R 13/6585*** | (2011.01) |
| ***H01R 13/6474*** | (2011.01) |
| ***H01R 13/6594*** | (2011.01) |
| ***H01R 13/6596*** | (2011.01) |

(52) U.S. Cl.

CPC ..... *H01R 13/405* (2013.01); *H01R 12/721* (2013.01); *H01R 12/724* (2013.01); *H01R 12/725* (2013.01); *H01R 13/6474* (2013.01); *H01R 13/6585* (2013.01); *H01R 13/6594* (2013.01); *H01R 13/6596* (2013.01)

(58) Field of Classification Search

CPC ..... H01R 13/405; H01R 13/6581; H01R 13/6585; H01R 13/6587

USPC ..... 439/607.01, 607.09, 607.11, 626

See application file for complete search history.

(56) References Cited

U.S. PATENT DOCUMENTS 5,929,553 A * 7/1999 Suzuki ..... H01L 41/107 310/355
6,398,598 B2 * 6/2002 Masumoto ..... H01R 13/2442 439/862
6,848,944 B2 * 2/2005 Evans ..... H01R 12/728 439/607.1
7,445,503 B1 * 11/2008 Zhang ..... H01R 13/41 439/607.01
7,445,504 B1 * 11/2008 Zhang ..... H01R 13/6594 439/607.01
8,414,332 B2 * 4/2013 Ju ..... H01R 13/41 439/342

(Continued)

*Primary Examiner* — Harshad C Patel

(74) *Attorney, Agent, or Firm* — CKC & Partners Co., LLC

(57) ABSTRACT

An electrical connector includes an insulator body including a mating cavity formed by a top plate, a bottom plate and two lateral plates. Two surfaces of the top plate and the bottom plate facing each other have a plurality of terminal trenches. A plurality of conductive terminals are respectively arranged in the terminal trenches of the insulator body. Each of the conductive terminals has a contact portion, a welding portion and a main body portion connected to the contact portion and the welding portion. The welding portions extend out of the insulator body respectively. Each of thicknesses of the contact portions is less than each of thicknesses of the main body portions, or each of widths of the contact portions is less than each of widths of the main body portions.

8 Claims, 11 Drawing Sheets

(56) References Cited

U.S. PATENT DOCUMENTS

| | | | | |
|---|---|---|---|---|
| 8,540,525 | B2 * | 9/2013 | Regnier | H01R 29/00 439/79 |
| 8,672,713 | B2 * | 3/2014 | Tajiri | H01R 12/585 439/630 |
| 8,777,667 | B2 * | 7/2014 | Huang | H01R 13/6582 439/607.35 |
| 9,419,390 | B2 * | 8/2016 | Hou | H01R 24/62 |
| 9,466,907 | B2 * | 10/2016 | Sakaue | H01R 24/60 |
| 9,692,183 | B2 * | 6/2017 | Phillips | H01R 13/6471 |
| 2005/0118892 | A1 * | 6/2005 | Shindo | H01R 13/05 439/857 |
| 2005/0277312 | A1 * | 12/2005 | Nakamura | H01R 12/585 439/82 |
| 2006/0189212 | A1 * | 8/2006 | Avery | H01R 12/724 439/607.05 |
| 2008/0182456 | A1 * | 7/2008 | Zhang | H01R 13/658 439/626 |
| 2009/0156021 | A1 * | 6/2009 | Polnyi | H01R 12/57 439/66 |
| 2010/0055992 | A1 * | 3/2010 | Liu | H01R 4/024 439/733.1 |
| 2011/0300757 | A1 * | 12/2011 | Regnier | H01R 29/00 439/626 |

* cited by examiner 51
52
5
51
52
411
43
412
43
32
31
32
44
41
411
412
422
421
35
4
421
42
422
412
4
35
5
33
34
52
51

ELECTRICAL CONNECTOR WITH CONDUCTIVE TERMINALS

CROSS-REFERENCE TO RELATED APPLICATION

This application claims priority to Taiwan Application Serial Number 106204892, filed Apr. 6, 2017, which is herein incorporated by reference.

BACKGROUND

Technical Field

The present disclosure relates to an electrical connector and, especially to an electrical connector having a serial attached SCSI (SAS) interface for adjusting high frequency signal transmission.

Description of Related Art

In pace with a development in computer and communication technologies, amount of data transmission has been considerably increased. Therefore, a connector plays an important role in creating communication between two devices. The connector has evolved from the traditional Small Computer System Interface (SCSI) to the current Serial Attached SCSI (SAS). The serial technique for high speed data-accessing overcomes traditionally technical difficulties and provides data transmission in higher speed. Moreover, the SAS is compatible with Serial Advanced Technology Attachment (SATA) devices, and hence it is beneficial for providing versatile applications.

In order to increase a signal transmission rate between two connectors, high frequency signal transmission is used. The connectors shrink down because of progress of manufacturing processes. Shrinkage of the connectors results in that internal structures such as terminals therein become too small such that issues during the high frequency signal transmission deteriorate, which affect a quality and a rate of the signal transmission. The issues may be, for example, impedances, propagation delay, propagation skew, attenuation, cross talk, and so on.

U.S. Pat. No. 8,777,667 discloses an electrical connector A. As shown in FIG. 11 (Prior Art), the electrical connector includes an insulator body B, a plurality of conductive terminals C and a shell D. The conductive terminals C include a plurality of top terminals C1 and a plurality of bottom terminals C2. Each of the conductive terminals C has a front end portion C3 and a rear end portion C4 connected by a connection portion C5. The top terminals C1 and the bottom terminals C2 are respectively mounted in the insulator body B. The rear end portions C4 of the conductive terminals C extend out of the insulator body B. The shell D encloses the insulator body B. The electrical connector A is free from a high frequency adjusting mechanism. High frequency signal transmission may result in issues such as increased interferences, parasitic capacitance and an abrupt change in the impedances.

When the conductive terminals are in contact with a plurality of corresponding mating conductive terminals, a total thickness of two contacted conductive terminals at the contact position is a total thickness of cross sections of the contacted conductive terminals. Capacitance between the neighboring conductive terminals increases due to increased opposing areas of the conductive terminals during the connection. The capacitance and the impedances are correlated, so that the impedance changes due to the contact of conductive terminals and the corresponding mating conductive terminals, resulting in affecting high frequency signal transmission efficiency.

The typical electrical connector as discussed above has a poor quality of high frequency signal transmission, so requirements of electronic industries cannot be satisfied. Therefore, an improvement for the electrical connector is desired to enhance the quality of high frequency signal transmission.

SUMMARY

Embodiments of the present disclosure provide an electrical connector including a plurality of conductive terminals. Each of the conductive terminals includes a contact portion, a welding portion and a main body portion connected to the welding portion and the contact portion. A thickness of each of the contact portions is less than a thickness of each of the main body portions. A width of each of the contact portions is less than a width of each of the main body portions. Adjustment of the thicknesses and widths of the contact portions can overcome the aforesaid high frequency signal transmission issues.

In some embodiments, the conductive terminals are enclosed by a fixing piece respectively. The fixing piece includes a plurality of through holes exposing the main body portions of the conductive terminals. The impedances of the conductive terminals can be adjusted by contact between main body portions and air.

In some embodiments, a ground sheet is disposed on a surface of the fixing piece. The ground sheet includes a plurality of contact arms. The contact arms are electrically connected to a plurality of ground terminals of the conductive terminals through certain through holes of the fixing piece. A grounding ability of the ground sheet and an electromagnetic interference shielding ability can be improved by the ground sheet, resulting in providing better transmission quality.

Embodiments of the present disclosure provide an electrical connector including an insulator body, a plurality of conductive terminals, a plurality of ground sheets and a shell. The insulator body includes a mating cavity formed by a top plate, a bottom plate and two lateral plates. Two surfaces of the top plate and the bottom plate facing each other have a plurality of terminal trenches. The conductive terminals are respectively arranged in the terminal trenches of the insulator body. Each of the conductive terminals has a contact portion, a welding portion and a main body portion connecting the contact portion and the welding portion. Each of the welding portions extends out of the insulator body. A thickness of the contact portion is less than a thickness of the main body portion. A step height is formed between the main body portion and the contact portion. The step height is a vertical step height or an inclined step height. The main body portions of the conductive terminals are respectively enclosed by two fixing pieces. Surfaces of the fixing pieces have a plurality of through holes exposing the conductive terminals respectively. The ground sheets include a plurality of contact arms and cover the surfaces of the fixing pieces respectively. The contact arms are electrically connected to a plurality of ground terminals of the conductive terminals through the through holes of the main body portions respectively. The shell is fixed to the insulator body.

It is to be understood that both the foregoing general description and the following detailed description are by examples, and are intended to provide further explanation of the present disclosure as claimed.

BRIEF DESCRIPTION OF THE DRAWINGS

The present disclosure can be more fully understood by reading the following detailed description of the embodiments, with reference made to the accompanying drawings as follows.

DETAILED DESCRIPTION

Figure 1:
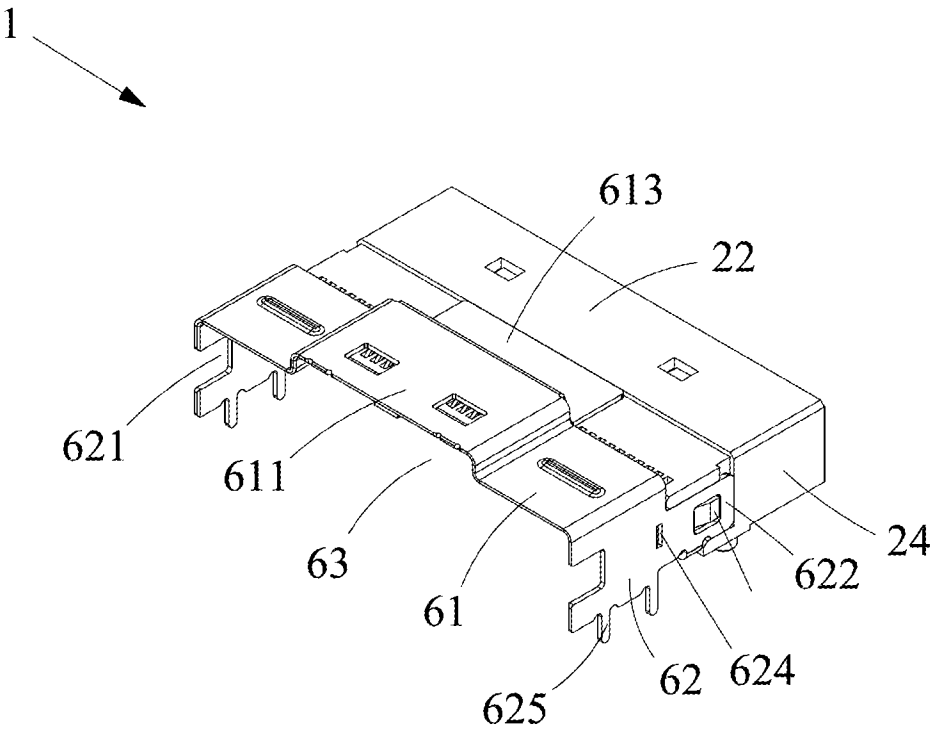
FIG. 1 is a perspective view of an electrical connector in accordance with some embodiments of the present disclosure.

Reference will now be made in detail to the present embodiments of the present disclosure, examples of which are illustrated in the accompanying drawings. Wherever possible, the same reference numbers are used in the drawings and the description to refer to the same or like parts.

Figure 2:
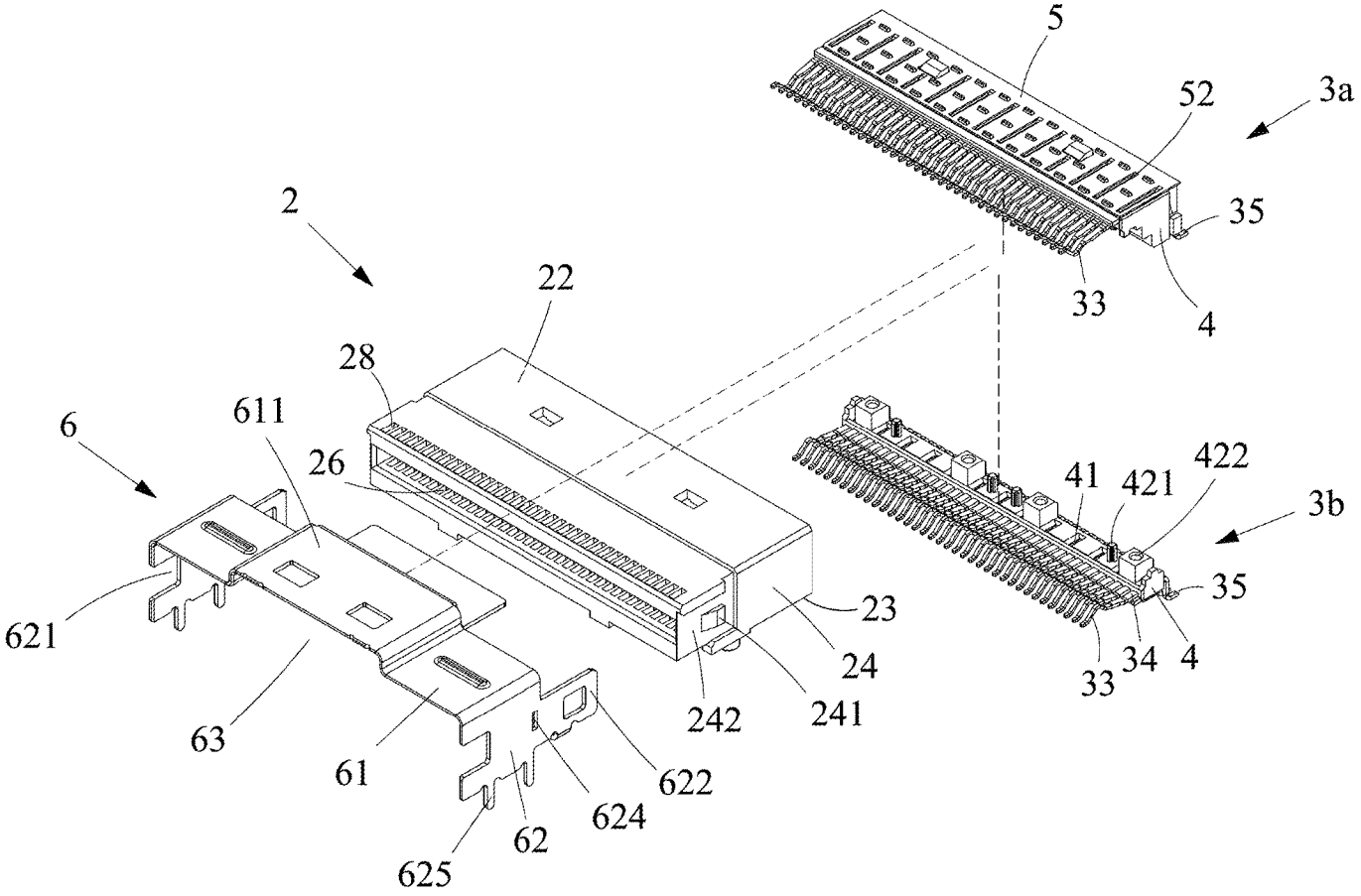
FIG. 2 is an exploded view of an electrical connector in accordance with some embodiments of the present disclosure.
Figure 3:
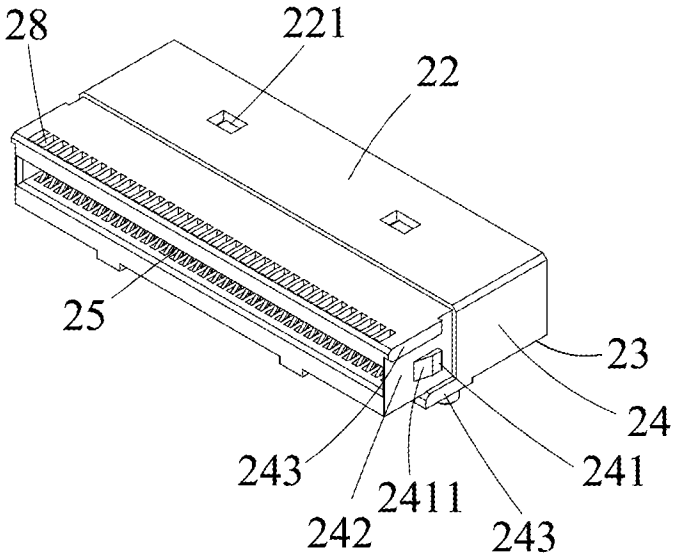
FIG. 3 is a perspective view of an insulator body in accordance with some embodiments of the present disclosure.

As shown in FIG. 1 and FIG. 2, embodiments of the present disclosure disclose an electrical connector capable of transmitting high frequency signals. The electrical connector 1 includes an insulator body 2, a plurality of conductive terminals 3, a plurality of fixing pieces 4, a plurality of ground sheets 5 and a shell 6. The electrical connector 1 can be secured to a circuit board (not shown) and can be connected with a mating apparatus (not shown) in a plugging manner.

Figure 7:
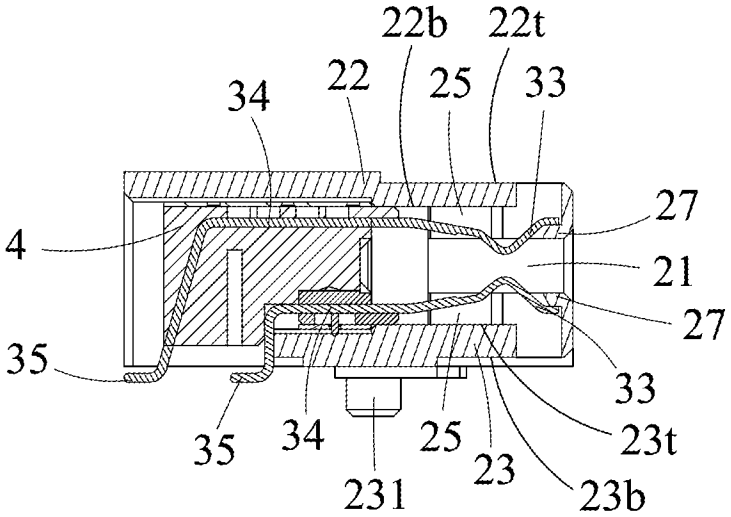
FIG. 7 is a fragmentary cross sectional view of an electrical connector in accordance with some embodiments of the present disclosure.

As shown in FIGS. 2, and 7, the insulator body 2 includes a mating cavity 21 formed by a top plate 22, a bottom plate 23 and two lateral plates 24. The top plate 22 has a top surface 22*t* and a bottom surface 22*b* opposite the top surface 22*t*. The bottom plate 23 has a top surface 23*t* and a bottom surface 23*b* opposite the top surface 23*t*. The bottom surface 22*b* of the top plate 22 and the top surface 23*t* of the bottom plate 23 face each other. A plurality of spacer walls 25 extend vertically from the bottom surface 22*b* of the top plate 22 and the top surface 23*t* of the bottom plate 23 facing each other respectively. The spacer walls 25 are adjacent to an opening of the mating cavity 21. The spacer walls 25 are parallel to each other and distances therebetween are the same. A plurality of terminal trenches 26 are formed between pairs of the neighboring spacer walls 25. The terminal trenches 26 are located on the top surfaces 23*t* of the bottom plate 23 and the bottom surface 22*b* of the top plate 22. A plurality of carrier plates 27 are disposed adjacent to an opening of the mating cavity 21. The carrier plates 27 are connected to the spacer walls 25 respectively. The carrier plates 27 are parallel to the top plates 22 and the bottom plates 23. A plurality of through holes 28 are formed on the top plates 22 and the bottom plates 23 at positions corresponding to the terminal trenches 26 and adjacent to the opening of the mating cavity 21. Therefore, the terminal trenches 26 can be spatially communicated with an external space outside the top plate 22 and the bottom plate 23 through the through holes 28. A plurality of latch holes 221 are formed on the top plate 22. The latch holes 221 are farther away from the opening of the mating cavity 21 than the through holes 28 being. A plurality of securing pins 231 are disposed on a surface of the bottom plate 23. The securing pins 231 can be either cylinders or cuboids. The electrical connector 1 can be assembled to a substrate or a circuit board by the securing pins 231.

A protrusion 241 and a guiding channel 242 are disposed on outer surfaces of the lateral plates 24 of the insulator body 2 adjacent to the opening of the mating cavity 21. The protrusions 241 and the guiding channels 242 can guide the shell 6 to be secured to the insulator body 2. Each of the guiding channels 242 is disposed between two ledges 243 on an outside surface of a corresponding one of the lateral plates 24. The ledges 243 are disposed on two sides neighboring the top plates 22 and the bottom plates 23 respectively. A recess formed between the ledges 243 is the guiding channel 242. The protrusions 241 are located in the guiding channels 242 respectively. Inclined surfaces 2411 are formed along a direction that the protrusions 241 face the open end of the mating cavity 21. The inclined surfaces 2411 and surfaces of the lateral plates 24 form acute angles, so that an object can be engaged with the protrusions 241.

Figure 8:
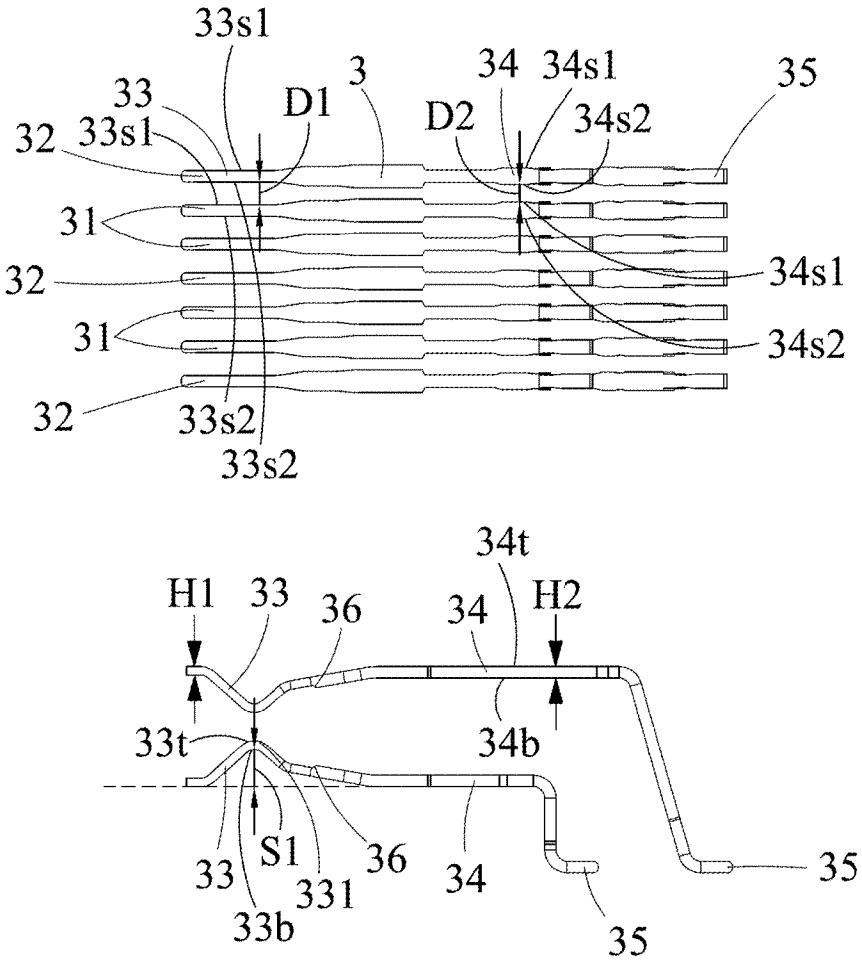
FIG. 8 is a side view and a top view of a conductive terminal in accordance with some embodiments of the present disclosure.
Figure 9:
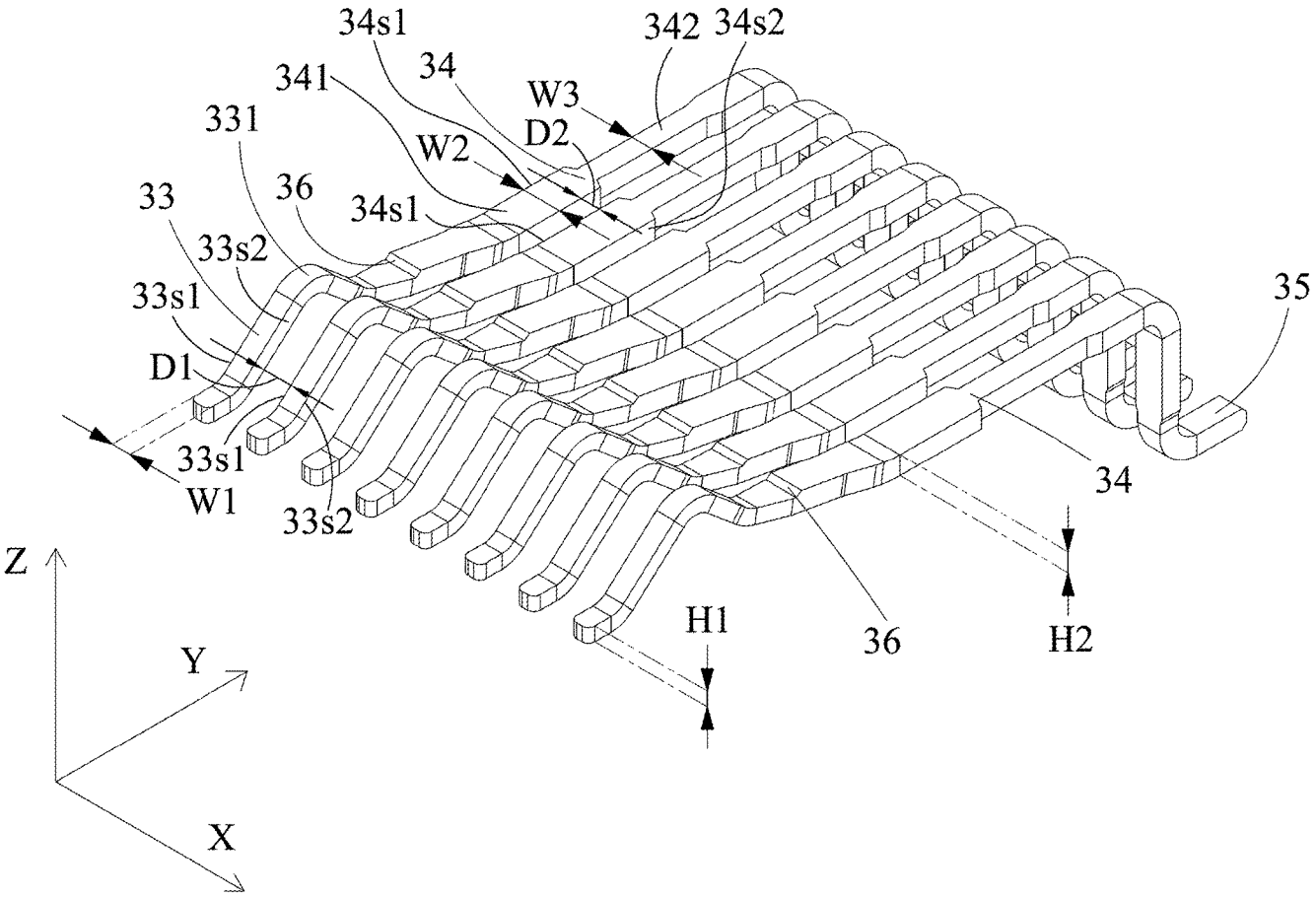
FIG. 9 is perspective view of a conductive terminal in accordance with some embodiments of the present disclosure.

As shown in FIG. 8 and FIG. 9, the conductive terminals 3 are one-piece formed by using, for example, cutting and stamping a metal sheet with a thickness (not shown). The conductive terminals 3 include a plurality of signal terminals 31 and a plurality of ground terminals 32. Each of the conductive terminals 3 has a contact portion 33, a welding portion 35 and a main body portion 34 connecting the contact portion 33 and the welding portion 35. A thickness of each of the conductive terminals 3 is a vertical distance between two opposed surfaces perpendicular to z axis. The contact portion 33 has a first thickness H1, and the main body portion 34 has a second thickness H2. The first thickness H1 of the contact portion 33 is less than the second thickness H2 of the main body portion 34. The first thickness H1 of the contact portion 33 is about 75% of the second thickness H2 of the main body portion 34. In other words, a difference between the thickness of the first thickness H1 of the contact portion 33 and the second thickness H2 of the main body portion 34 is about 25% of the second thickness H2 or more. The contact portion 33 has a top surface 33*t* and a bottom surface 33*b* opposite the top surface 33*t*. The main body portion 34 has a top surface 34*t* and a bottom surface 34*b* opposite the top surface 34*t*. Due to the difference of thicknesses, a step height S1 is formed between a bottom surface 33*b* of each of the contact portions 33 and a bottom surface 34*b* of each of the corresponding main body portions 34. The step height S1 between the bottom surface 33*b* of each of the contact portions 33 and the bottom surface 34*b* of corresponding one of the main body portions 34 is a staircase-like vertical step height or an inclined step height along an inclined surface 36. The inclined surfaces 36 are formed on at least one surface between the contact portions 33 and the main body portions 34.

Due to the shrinkage of the conductive terminals 3, the conductive terminals 3 are respectively formed on two fixing pieces 4 using, for example, an insert molding technique. The two fixing pieces 4 are fixed on the main body portions 34 of the conductive terminals 3 respectively and hence a set of first conductive terminals 3*a* and a set of second conductive terminals 3*b* are formed. As shown in FIG. 9, a width of each of the conductive terminals 3 is a vertical distance between two opposed surfaces of the conductive terminals 3 perpendicular to x axis. The width direction of the each conductive terminal is the same as an arrangement direction of the terminal trenches. The contact portion 33 has a first width W1. The main body portion 34 has a second width W2 and a third width W3. The second width W2 is a width of a portion of the main body portion 34 not enclosed by the fixing piece 4. The third width W3 is a width of a portion of the main body portion 34 enclosed by the fixing pieces 4. The first width W1 of the contact portion 33 is less than the second width W2 and the third width W3 of the main body portion 34. The second width W2 of the main body portion 34 is greater than the third width W3 of the main body portion 34. The contact portion 33 has opposed side surfaces 33*s*1, 33*s*2. The side surface 33*s*1 of the contact portion 33 and the side surface 33*s*2 of the neighboring contact portion 33 face each other and have a distance D1 therebetween. The main body portion 34 has opposed side surfaces 34*s*1, 34*s*2. The side surface 34*s*1 of the main body portion 34 and the side surface 34*s*2 of the neighboring main body portion 34 face each other and have a distance D2 therebetween. In particular, the main body portion 34 has a first portion 341 and a second portion 342 connected to the first portion 341. The first portion 341 of the main body portion 34 is not enclosed by the fixing piece 4. The second portion 342 of the main body portion 34 is enclosed by the fixing piece 4. By using such a configuration, distances between the neighboring parallel contact portions 33 are greater than distances between the first portions 341 of the neighboring main body portions 34 not enclosed by the fixing piece 4. Because the first thickness H1 and the first width W1 of the contact portion 33 are less than that of the main body portion 34, capacitance between the neighboring conductive terminals 3 are adjusted, and impedances change as well, and hence signal transmission becomes more stable. Therefore, a quality of high frequency signal transmission of conductive terminals 3 can be improved.

At least one pair of neighboring signal terminals 31 of the set of first conductive terminals 3*a* and the set of second conductive terminals 3*b* form a differential signal pair respectively. Therefore, differential electric signals can be transmitted by the differential signal pair. Outer sides of the differential signal pair are adjacent to two ground terminals 32. By using ground-signal-signal-ground (GSSG) arrangement, electromagnetic noises generated from transmission of high frequency differential signals via the differential signal pair can be grounded by the ground terminals 32 on two sides of the differential signal pair, and hence interference to other signal terminals is reduced effectively during the high frequency signal transmission.

Figure 4:
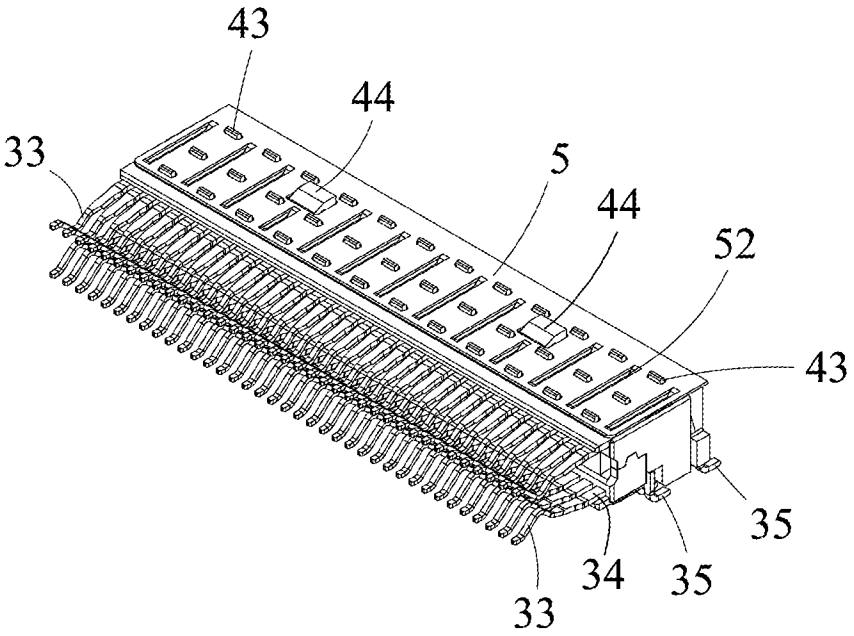
FIG. 4 is a fragmentary perspective view of an electrical connector in accordance with some embodiments of the present disclosure.
Figure 5:
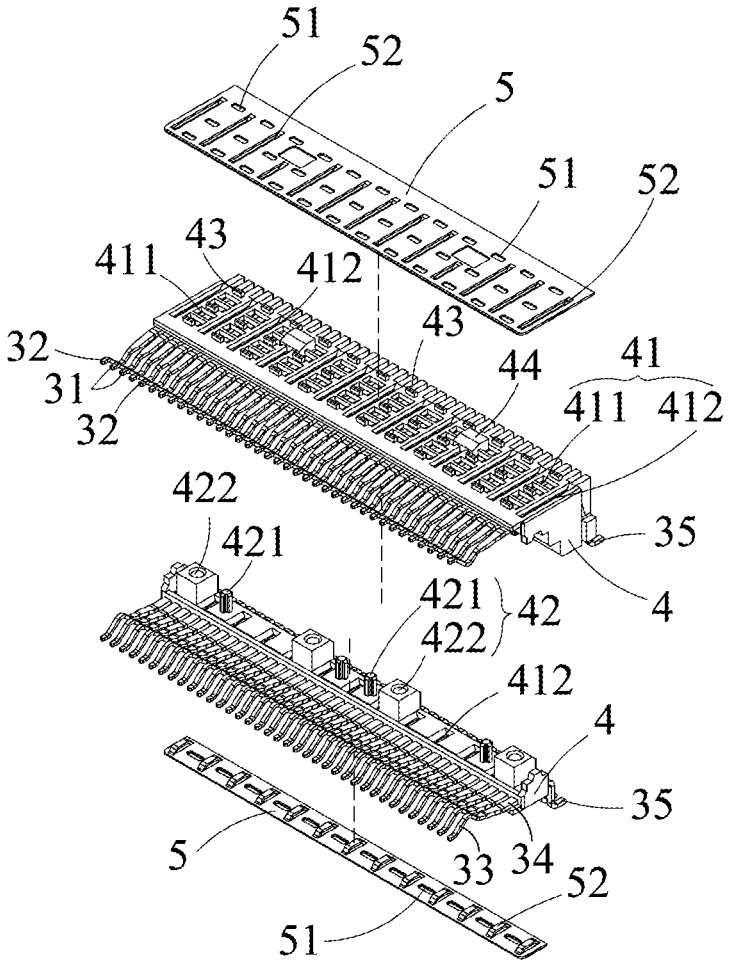
FIG. 5 is a fragmentary exploded view of an electrical connector in accordance with some embodiments of the present disclosure.

As shown in FIG. 4 and FIG. 5, the fixing pieces 4 have a plurality of through holes 41, a plurality of positioning members 42, a plurality of protrusion members 43 and a plurality of latch members 44. The through holes 41 are disposed on two opposed surfaces of the fixing pieces 4 respectively. The through holes 41 include a plurality of first through holes 411 and a plurality of second through holes 412. The first through holes 411 expose the signal terminals 31 of the conductive terminals 3 respectively. The second through holes 412 expose the ground terminals 32 respectively. The signal terminals 31 are arranged in differential signal pair manner and fixed in the fixing pieces 4 respectively. Each of the differential signal pairs is exposed on the fixing pieces 4 through at least one first through hole 411, so that a portion of the main body portions 34 of the differential signal pairs is exposed to air and hence an area of the conductive terminals 3 covered with the fixing pieces 4 is reduced. Since each of the fixing pieces 4 has a dielectric constant greater than air, when a greater area of the conductive terminals 3 is exposed to air through the first through holes 411, high frequency characteristics of the electrical connector 1 become better and hence a better quality of high frequency signal transmission is obtained.

The positioning members 42 are disposed on two opposed surfaces of the two fixing pieces 4. The positioning members 42 include a plurality of protruding posts 421 and a plurality of receiving portions 422 coupled with the protruding posts 421. The protruding posts 421 of one of the fixing piece 4 are disposed corresponding to the receiving portions 422 of the other fixing piece 4. Therefore, the two fixing pieces 4 can be coupled and fixed together by the protruding posts 421 and the receiving portions 422. Meanwhile, the set of first conductive terminals 3*a* and the set of second conductive terminals 3*b* are assembled together. The protrusion members 43 and the latch members 44 are disposed on surfaces of the fixing pieces 4. The protrusion members 43 and the latch members 44 are adjacent to the through holes 41 respectively.

In some embodiments, as shown in FIG. 4 and FIG. 5, the ground sheets 5 are formed using a process such as stamping a metal sheet. The ground sheets 5 include a plurality of holes 51 and a plurality of contact arms 52. The holes 51 and the contact arms 52 are disposed in an alternating manner. Sizes of the holes 51 and sizes of the protrusion members 43 of the fixing pieces 4 are the same. The contact arms 52 are formed by a process of stamping the ground sheets 5 to protrude from surfaces of the ground sheets 5. The contact arms 52 can be ribs or elastic tabs. A portion of the ground sheets 5 is still connected to the contact arms 52. The ground sheets 5 can be disposed on the surfaces of the fixing pieces 4 or clamped between the fixing pieces 4.

The ground sheets 5 can be fixed to the fixing pieces 4 by using, for example, hot pressing, latching, embedding or clamping. In some of the embodiments, the ground sheets 5 are fixed by hot pressing. The holes 51 of the ground sheets 5 receive the protrusion members 43 of the fixing pieces 4 respectively. The protrusion members 43 are softened due to a high temperature of the hot pressing and hence covering surfaces of the corresponding ground sheets 5. After the protrusion members 43 cool down, the ground sheets 5 are clamped between the protrusion members 43 and the fixing pieces 4, so that the ground sheets 5 are respectively mounted on surfaces of the fixing pieces 4 stably. The contact arms 52 of the ground sheets 5 are in contact with and electrically connected to the ground terminals 32 through the second through holes 412 of the fixing pieces 4 respectively. The ground sheets 5 respectively covered by the fixing pieces 4 are beneficial for improving an electromagnetic shielding ability of the conductive terminals 3. The ground sheets 5 and the ground terminals 32 are electrically connected, so that a ground ability of the ground terminals 32 is improved. In other words, the ground terminals 32 are electrically connected to each other by the ground sheets 5. Therefore, when one ground terminal 32 receives a considerable number of noises, these noises can be distributed to other ground terminals 32 by the contact arms of the ground sheets 5. As a result, a grounding efficiency for the noises can be improved and thus functionality and efficiency of each of the ground terminals 32 are improved.

As shown in FIG. 7, the ground sheets 5 are mounted on the surfaces of the fixing pieces 4. The set of first conductive terminals 3*a* and the set of second conductive terminals 3*b* are assembled together by the fixing pieces 4 and then mounted in the mating cavity 21 of the insulator body 2. The latch members 44 of the fixing pieces 4 are fixed to the latch holes 221 of the top plates 22 of the insulator body 2 respectively. The contact portions 33 of the conductive terminals 3 are disposed in the terminals trenches 26 of the insulator body 2 respectively. A mating portion 331 extends from the contact portions 33 of the set of first conductive terminals 3*a* and the set of second conductive terminals 3*b* along a direction toward the mating cavity 21 respectively. Front ends of the contact portions 33 of the conductive terminals 3 contact the corresponding carrier plates 27. The welding portions 35 extend out of the insulator body 2 respectively.

The front ends of the contact portions 33 of the conductive terminals 3 apply a force to the corresponding carrier plates 27. The front ends of the contact portions 33 are restricted by the carrier plates 27, so that the contact portions 33 can only be elastically deformed in a direction away from the carrier plates 27. Therefore, the carrier plates 27 apply a pre-load to the contact portions 33 when the contact portions 33 are not in contact with the mating apparatus. When the mating apparatus plugs into the electrical connector 1, the contact portions 33 of the conductive terminals 3 can generate a greater normal force, so that the signal transmission of the conductive terminals 3 can be more stable. The through holes 28 penetrate through each of the terminal trenches 26 of the top plates 22 and the bottom plates 23. The through holes 28 are adjacent to the opening of the mating cavity 21 and increase a plurality of buffer spaces. The buffer spaces allow elastic deformation of the contact portions 33 when the conductive terminals 3 contact the mating apparatus, and hence irreversible breakage or deformation are avoided during the conductive terminals 3 pressing the top plates 22 and the bottom plates 23.

Figure 10:
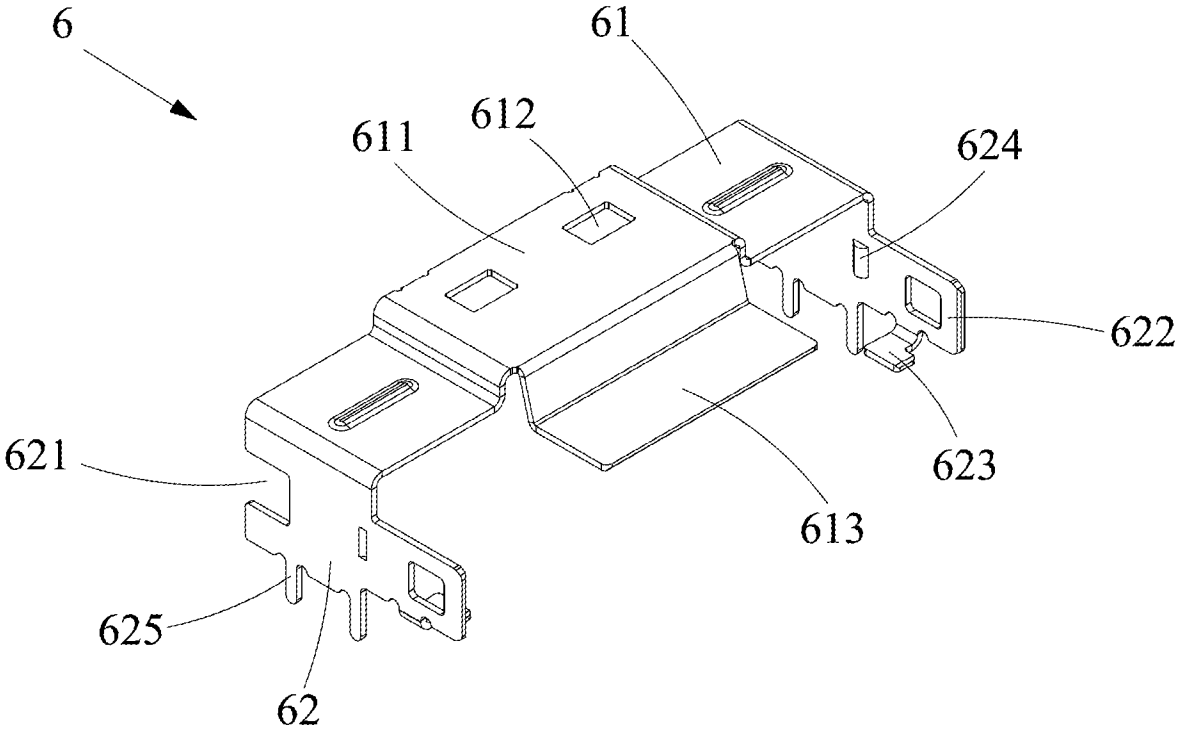
FIG. 10 is a perspective view of a shell in accordance with some embodiments of the present disclosure.
Figure 11:
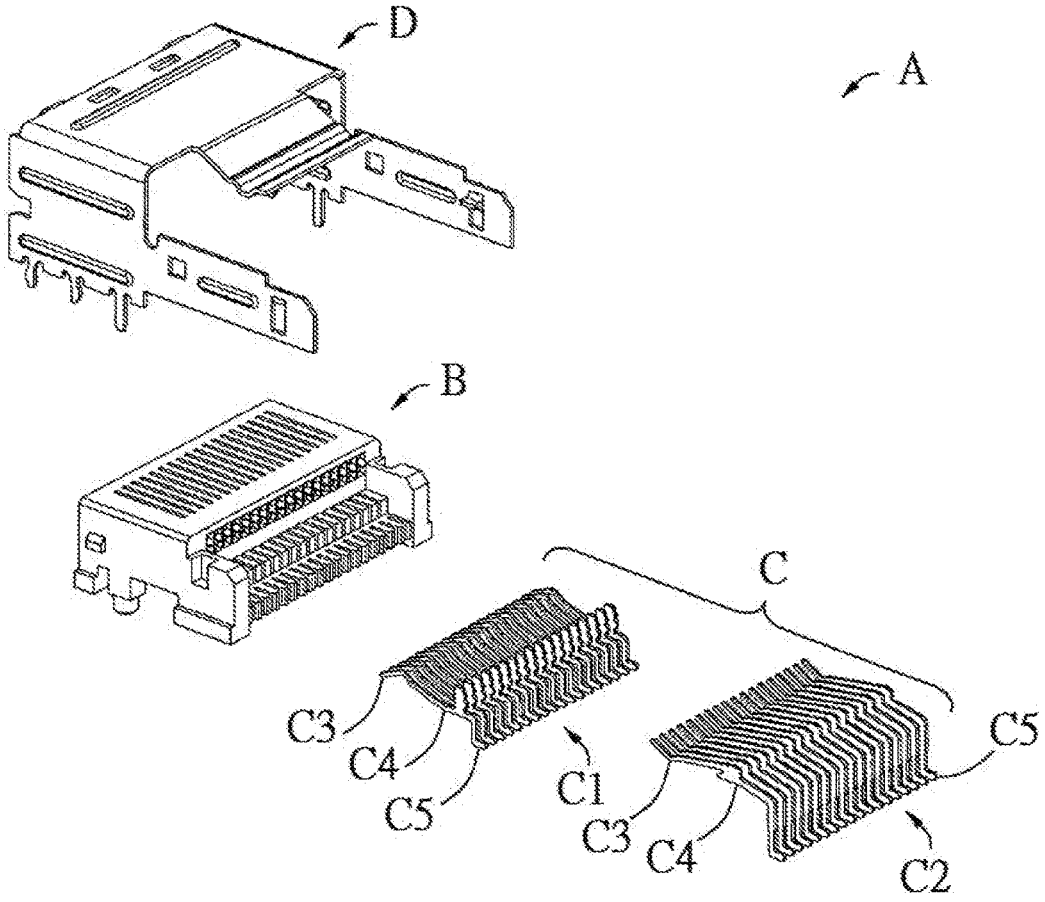
Fig. 11 (PRIOR ART)
FIG. 11 (Prior Art) is an exploded view of an electrical connector in a U.S. Pat. No. 8,777,667.

As shown in FIG. 10, the shell 6 is made from metal and includes a top wall 61 and two side walls 62. The side walls 62 extend along two opposite sides of the top wall 61 and form a receiving cavity 63. The side walls 62 are parallel to each other. The top wall 61 has a connecting portion 611. The connecting portion 611 is perpendicular to a surface of the top wall 61 and protrudes away from the receiving cavity 63. A plurality of mating holes 612 are disposed on a surface of the connecting portion 611 so as to fix the mating apparatus. A cover portion 613 extends from the connecting portion 611. A notch 621 is formed in an edge of the side walls 62. A buckle 622 extends from another edge opposed to the edge where the notch 621 is disposed. A bending portion 623 extends from a side of the buckle 622. A protecting structure 624 is disposed at a boundary between one side wall 62 and one buckle 622. The protecting structures 624 are perpendicular to the side walls 62 and extend to the receiving cavity 63. The protecting structures 624 can protect the insulator body 2 from damage. A plurality of tabs 625 extend from another edge of the side walls 62 respectively.

In some embodiments, as shown in FIG. 1, the buckles 622 extending from the side walls 62 of the shell 6 are assembled with the guiding channels 242 respectively along an outside surface of the side plates 24 of the insulator body 2, so that the buckles 622 are buckled to the corresponding protrusions 241 respectively. The two opposite bending portions 623 extending from the buckles 622 extend to and are fixed to the insulator body 2. Therefore, the shell 6 is fixed more firmly to the insulator body 2. The protecting structures 624 are adjacent to the side plates 24 which are adjacent to the opening of the mating cavity 21 of the insulator body 2. A function of the protecting structure 624 is to guide a plugging direction of a tongue plate (not shown) of the mating apparatus. Therefore, the tongue plate can be plugged into the mating cavity 21 of the insulator body 2. The protecting structures 624 can prevent the tongue plates from scratching the insulator body 2 so as to extend life of the electrical connector 1. The cover portion 613 extends to a surface of the top plate 22 from the connecting portion 611. The receiving cavity 63 formed by the shell 6 are in connection with the mating cavity 21 of the insulator body 2. In some embodiments, the shell 6 can be absent in the electrical connector 1 as well.

Figure 6:
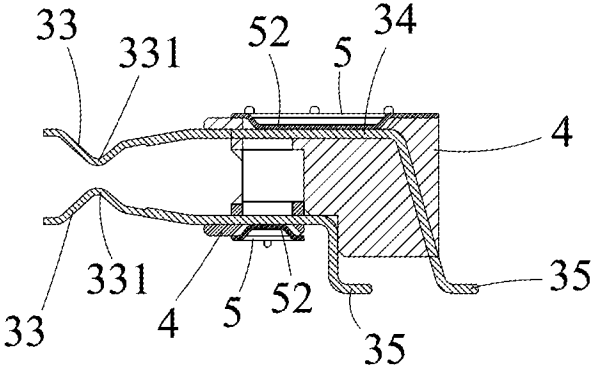
FIG. 6 is a fragmentary cross sectional view of an electrical connector in accordance with some embodiments of the present disclosure.

As shown in FIG. 6, the contact arms 52 of the ground sheets 5 and the main body portions 34 of the ground terminals 32 are in contact with each other. Opposed surfaces of the contact arms 52 and the ground terminals 32 form a plurality of contact surfaces respectively. Differences in contact surface areas induced by improper mating positions or non-uniform flatness may result in an unpredictable electrical resistance and poor bonding or connection. Such an issue can be avoided and an electrical connection can be stabilized by a solder layer of tin on the contact arms 52 of the ground sheets 5 or on the main body portions 34 of the ground terminals 32. The ground sheets 5 are fixed to the corresponding fixing pieces 4 respectively. Meanwhile, the contact arms 52 of the ground sheets 5 and the main body portions 34 of the ground terminals 32 are in contact with each other through the second through holes 412 of the fixing pieces 4. A heating process is performed to the contact arms 52 and the main body portions 34 of the ground terminals 32, so that the solder layers of tin are in a molten state. The molten solder layer of tin covers contact surfaces of the contact arms 52 and the corresponding contact surfaces of the main body portions 34 of the ground terminals 32. Therefore, the contact arms 52 and the corresponding ground terminals 32 are fixed together by the tin solder after a cooling process. A quality of the electrical connection is improved and hence a better ground ability is attained.

In some embodiments, an impedance of the conductive terminal is given by $Z_0=[(R+j\omega L)/(G+j\omega C)]^{1/2}$, where R is a series resistance, G is a shunt conductance, L is a series inductance, C is a shunt capacitance, and ω is an angular frequency. A relation shown as $Z_0 \propto (L/C)^{1/2}$ is given by the function $Z_0=[(R+j\omega L)/(G+j\omega C)]^{1/2}$. A capacitance is given by $C=\varepsilon A/d$, which is obtained by solving Gauss's law, where ε is a dielectric constant of a dielectric medium layer in a capacitor, A is an area of two conductive plates in a capacitor, and d is a distance between the two conductive plates in a capacitor. In the present disclosure, a capacitance is tuned by adjusting a configuration of the conductive terminals 3, so that the impedance is adjusted as well. Since feature sizes of the electrical connectors 1 become smaller, distances between the neighboring conductive terminals 3 are reduced as well. Therefore, capacitance induced between the conductive terminals 3 increases significantly. When the electrical connector 1 is mated with the mating apparatus, the conductive terminals 3 and a plurality of mating conductive terminals of the mating apparatus (not shown) are in contact and overlap with each other. A thickness of an overlapping area of the conductive terminals 3 and the mating conductive terminals is greater than other portions of the conductive terminals 3, thus increasing opposed surface areas of the conductive terminals 3 and the mating conductive terminals. Therefore, charge accumulations become considerable and result in violent capacitance effect.

In some embodiments, adjusting the configuration of the conductive terminals 3 is beneficial for addressing the capacitance effect issue as stated above. According to the formulations above, three factors are significant in the capacitance effect. The three factors are a distance between two neighboring conductive terminals 3, opposed surface areas of the two neighboring conductive terminals 3 and a dielectric constant of dielectric medium layer between the two neighboring conductive terminals 3. Since a concern of increased opposed surface areas caused by mating the contact portions 33 of the conductive terminals 3 and the mating apparatus together may induce capacitance effect, thicknesses of the contact portions 33 of the conductive terminals 3 are adjusted. The opposed surface areas of the two neighboring contact portions 33 can be reduced by reducing thicknesses of the contact portions 33, so that the capacitance effect may be reduced.

The capacitance effect may be reduced by increasing the distance between the two neighboring conductive terminals 3 as well. Widths of the contact portions 33 of the conductive terminals 3 are less than widths of the main body portions 34, so that a distance between each of the contact portions 33 is greater than a distance between each of the main body portions 34. Therefore, the capacitance effect is reduced.

The fixing pieces 4 are made from plastic material. Since each of the fixing pieces 4 has a dielectric constant greater than air, an amount of accumulated charge in the main body portions 34 enclosed in the fixing pieces 4 is increased. Therefore, a capacitance effect of the main body portions 34 in the fixing pieces 4 is greater than a capacitance effect of the main body portions 34 exposed to air. To address such a capacitance effect issue, widths of the main body portions 34 of the conductive terminals 3 enclosed in the fixing pieces 4 are reduced, so that distances between each of the neighboring main body portions 34 in the fixing pieces 4 are increased. The main body portions 34 in the fixing pieces 4 are exposed to air by the through holes 41 respectively. Therefore, a spacing between neighboring main body portions 34 is increased, and a contact area between the conductive terminals 3 and the fixing pieces 4 is reduced. A reduced capacitance effect is attained thereby. By using such a configuration, each of the capacitance effects of the neighboring contact portions 33, main body portions 34 and the welding portions 35 of the conductive terminals 3 is reduced respectively and becomes the same. Therefore, a consistency of impedance between measurements is attained and hence the quality of high frequency signal transmission is improved.

In some embodiments, the electrical connector 1 for transmitting high frequency signals with improved conductive terminals 3 is disclosed compared to the prior art. Widths and thicknesses of conductive terminals of an electrical connector are usually the same for convenience of manufacture. In recent years, a high frequency is preferred to satisfy requirements of transmitting a large amount of data. Due to electrical connectors with small feature sizes, distances between two neighboring conductive terminals 3 become too small, so that many capacitance effect issues occur. To help solve such issues, the present disclosure provides the configuration of conductive terminals 3 which can reduce capacitance effects. By controlling thicknesses of the contact portions 33 less than thicknesses of the main body portions 34 and by controlling widths of the contact portions 33 less than widths of the main body portions 34, capacitance effects and impedances of the electrical connector 1 are modified. The impedances of the electrical connector 1 are increased due to the reduced capacitance effects of the electrical connector 1 when the contact portions 33 are mated with the mating apparatus. Therefore, the high frequency signal transmission of the electrical connector 1 satisfies industry standard requirements.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present disclosure cover modifications and variations of this disclosure provided they fall within the scope of the following claims.

What is claimed is:

1. An electrical connector, comprising:

an insulator body comprising a mating cavity, the mating cavity formed by a top plate, a bottom plate and two lateral plates, the top plate having a first top surface and a first bottom surface opposite the first top surface, the bottom plate having a second top surface and a second bottom surface opposite the second top surface, the first bottom surface of the top plate and the second top surface of the bottom plate facing each other, the first bottom surface of the top plate and the second top surface of the bottom plate having a plurality of terminal trenches respectively; and a plurality of conductive terminals formed by a metal sheet with a thickness, the conductive terminals respectively arranged in the terminal trenches of the insulator body, each of the conductive terminals having a width in an arrangement direction of the terminal trenches, each of the conductive terminals having a contact portion, a welding portion and a main body portion connecting the contact portion and the welding portion, and each of the welding portions extends out of the insulator body, wherein a thickness of each of the contact portions perpendicular to the arrangement direction of the terminal trenches is less than a thickness of each of the main body portions perpendicular to the arrangement direction of the terminal trenches, a width of each of the contact portions parallel to the arrangement direction of the terminal trenches is less than a width of each of the main body portions parallel to the arrangement direction of the terminal trenches, a first portion of the main body portions of the conductive terminals are respectively enclosed by two fixing pieces, the fixing pieces have a plurality of through holes exposing the first portion of the main body portions of the conductive terminals, and a width of the first portion of each of the main body portions in the fixing pieces is less than a width of a second portion of each of the main body portions outside the fixing pieces.

2. The electrical connector of claim 1, wherein a step height is formed between a bottom surface of the main body portion and a bottom surface of the contact portion.

3. The electrical connector of claim 2, wherein the step height between the bottom surface of the main body portion and the bottom surface of the contact portion is a vertical step height or an inclined step height.

4. The electrical connector of claim 1, wherein a distance between side surfaces of the contact portions of the neighboring conductive terminals is greater than a distance between side surfaces of the main body portions of the neighboring conductive terminals.

5. The electrical connector of claim 1, wherein the fixing pieces and at least one ground sheet are in contact with each other, the ground sheet comprises a plurality of contact arms, and the contact arms are electrically connected to a plurality of ground terminals of the conductive terminals in the through holes.

6. The electrical connector of claim 5, wherein the ground sheet is capable of being clamped between the two fixing pieces or respectively mounted on surfaces of the fixing pieces.

7. The electrical connector of claim 1, wherein a distance between side surfaces of the contact portions of neighboring two of the conductive terminals is greater than a distance between side surfaces of the main body portions of neighboring two of the conductive terminals.

8. The electrical connector of claim 1, further comprising a shell fixed to the insulator body.

* * * * *